US011717049B2

(12) United States Patent
Hedström

(10) Patent No.: US 11,717,049 B2
(45) Date of Patent: Aug. 8, 2023

(54) INSOLE FOR FOOTWEAR

(71) Applicant: Stinaa & J Fashion AB, Stockholm (SE)

(72) Inventor: Peter Hedström, Umeå (SE)

(73) Assignee: STINAA & J FASHION AB, Stockholm (SE)

( * ) Notice: Subject to any disclaimer, the term of this patent is extended or adjusted under 35 U.S.C. 154(b) by 76 days.

(21) Appl. No.: 16/304,562

(22) PCT Filed: May 24, 2017

(86) PCT No.: PCT/SE2017/050557
§ 371 (c)(1),
(2) Date: Nov. 26, 2018

(87) PCT Pub. No.: WO2017/204738
PCT Pub. Date: Nov. 30, 2017

(65) Prior Publication Data

US 2019/0216165 A1 Jul. 18, 2019

(30) Foreign Application Priority Data

May 27, 2016 (SE) ..... 1650732-9

(51) Int. Cl.
*A43B 7/1405* (2022.01)
*A43B 7/142* (2022.01)
(Continued)

(52) U.S. Cl.
CPC ..... *A43B 7/141* (2013.01); *A43B 7/142* (2013.01); *A43B 7/143* (2013.01); *A43B 7/1425* (2013.01);
(Continued)

(58) Field of Classification Search
CPC ..... A43B 7/141; A43B 7/142; A43B 7/1425; A43B 7/143; A43B 7/1445; A43B 23/222;
(Continued)

(56) References Cited

U.S. PATENT DOCUMENTS 1,399,447 A * 12/1921 Spiegel ..... A43B 7/22 36/168
1,709,635 A 4/1929 Skoglund
(Continued)

FOREIGN PATENT DOCUMENTS

DE 9420397 2/1995
FR 2842710 A1 1/2004
(Continued)

OTHER PUBLICATIONS

International Search Report for related International Application No. PCT/SE2017/050557 dated Aug. 16, 2017.
(Continued)

*Primary Examiner* — Khoa D Huynh
*Assistant Examiner* — Uyen T Nguyen
(74) *Attorney, Agent, or Firm* — Renner, Otto, Boisselle & Sklar, LLP

(57) ABSTRACT

Insole (34) for footwear, the insole (34) comprising an anterior arch support (48); and an anterior reinforcing bridge (54) having a raised section (56) for providing resistance against compression of the anterior arch support (48).

16 Claims, 5 Drawing Sheets

(51) Int. Cl.

| | |
|---|---|
| ***A43B 7/143*** | (2022.01) |
| ***A43B 7/1445*** | (2022.01) |
| ***A43B 23/22*** | (2006.01) |
| ***A43B 7/1425*** | (2022.01) |
| ***A43B 17/00*** | (2006.01) |
| ***A43B 17/02*** | (2006.01) |

(52) U.S. Cl.
CPC ..... *A43B 7/1445* (2013.01); *A43B 17/006* (2013.01); *A43B 17/02* (2013.01); *A43B 23/222* (2013.01)

(58) Field of Classification Search
CPC ..... A43B 17/006; A43B 17/02; A43B 17/00; A43B 17/003; A43B 17/06; A43B 23/22; A61F 5/14
USPC ..... 36/44
See application file for complete search history.

(56) References Cited

U.S. PATENT DOCUMENTS 2,811,791 A 11/1957 Cox
3,081,774 A * 3/1963 Lelyveld ..... A43B 7/142 36/174
3,543,765 A * 12/1970 Alzner ..... A43B 7/142 36/147
4,571,857 A * 2/1986 Castellanos ..... A43B 7/142 36/154
4,739,765 A 4/1988 Sydor et al.
5,675,914 A * 10/1997 Cintron ..... A43B 17/08 36/3 R
6,408,543 B1 * 6/2002 Erickson ..... A43B 7/16 36/28
2005/0034328 A1 * 2/2005 Geer ..... A43B 13/10 36/30 R
2005/0223604 A1 10/2005 Neuner
2007/0033834 A1 * 2/2007 Cheskin ..... A43B 7/223 36/28
2007/0074430 A1 * 4/2007 Coomer ..... A43B 7/143 36/145
2008/0010861 A1 * 1/2008 Kosmas ..... A43B 7/1445 36/91
2010/0205831 A1 * 8/2010 Cheskin ..... A43B 13/12 36/44
2011/0041360 A1 2/2011 Torrance et al.
2011/0247235 A1 * 10/2011 de Roode ..... A43B 7/144 36/44
2013/0111781 A1 5/2013 Jaeger et al.
2013/0318818 A1 * 12/2013 Gardiner ..... A43B 13/38 36/43
2014/0310981 A1 * 10/2014 Abshire ..... A43B 7/1445 36/28
2015/0026998 A1 * 1/2015 Lin ..... A43B 7/144 36/44
2015/0059204 A1 * 3/2015 Alexander ..... A43B 3/26 36/44
2015/0135553 A1 * 5/2015 Sturgis ..... A43B 7/141 36/88
2015/0237959 A1 * 8/2015 Wynn ..... A43B 13/188 12/146 M
2015/0335460 A1 * 11/2015 Weaver, II ..... A61F 5/01 602/7
2016/0073730 A1 * 3/2016 Martinez ..... A43B 7/144 36/44
2016/0353838 A1 * 12/2016 Takeshita ..... A43B 7/1445
2018/0192739 A1 * 7/2018 Granger ..... A43B 17/14

FOREIGN PATENT DOCUMENTS

GB 1558195 12/1979
WO WO 2006/040415 A1 4/2006

OTHER PUBLICATIONS

International Preliminary Report on Patentability for related International Application No. PCT/SE2017/050557 dated Nov. 27, 2018.
Extended European Search Report for related European Application No. 17803174.6 dated Dec. 16, 2019.
Official Action for related European Application No. 17803174.6 dated Mar. 27, 2020.

* cited by examiner

INSOLE FOR FOOTWEAR

TECHNICAL FIELD

The present disclosure generally relates to insoles for footwear. In particular, an insole comprising at least one reinforcing bridge and a footwear comprising the insole are provided.

BACKGROUND

Various solutions exist for insoles in order to improve the anatomical position of the foot in the shoe and prevent injuries and/or pain. Some insoles provide support to the three arches of the foot: the anterior arch, the medial arch and the lateral arch, for example by means of inserts in the insole or by means of locally thicker regions in the insole.

US 20130111781 A1 discloses an orthopaedic shoe insert to support and guide the foot. The shoe insert comprises an insert core having a carrier and a support clasp. The support clasp comprises two individually adjustable diagonally opposite support arms having a higher mechanical strength.

SUMMARY

Some prior art insoles comprise arch supports with an initial shape when the insole or shoe is new. However, many of these prior art arch supports change in shape over time when the shoe is used, for example due to compression forces from the wearer's weight, impacts, moisture, material ageing and/or exposure to sunlight. As a consequence, the arch supports might lose their intended function and the wearer might get injuries in the feet, knees, hip and/or back. The shoe might also become painful to wear.

Many of these types of prior art insoles do also not provide a sufficient rigidity in terms of twisting forces along the longitudinal axis of the insole. This type of twisting of the feet might also lead to injuries and pain.

On the other hand, some prior art insoles comprise more rigid arch supports that better maintain their initial shape over time. However, these prior art insoles are often too rigid and thereby impair the flexibility of the feet and prevent the natural movements of the feet when walking or running. Although some problems related to a lack of arch support may be avoided with these types of insoles, the inflexible design might cause new types of injuries and pain. These types of prior art insoles also often use an excess amount of material for the supports leading to a higher weight of the shoe and added costs.

One object of the present disclosure is to provide an insole that gives an anatomically correct support to the anterior arch of the foot and maintains this support over time.

A further object of the present disclosure is to provide an insole that gives an anatomically correct support to the medial arch and the lateral arch of the foot and maintains this support over time.

A still further object of the present disclosure is to provide an insole that reduces twisting of the insole about a longitudinal axis of the insole.

A still further object of the present disclosure is to provide an insole that has good flexibility to allow the foot to move during walking and/or running.

A still further object of the present disclosure is to provide an insole that has a simple structure and enables a simple and cheap production.

A still further object of the present disclosure is to provide an insole that has a low weight.

According to one aspect of the present disclosure, there is provided an insole for footwear, the insole comprising an anterior arch support; and an anterior reinforcing bridge having a raised section for providing resistance against compression of the anterior arch support. The raised section is raised vertically with respect to a general horizontal plane of the insole.

The anterior reinforcing bridge thus adds rigidity to the anterior arch support and contributes to maintaining the original shape of the anterior arch support over time. Throughout the present disclosure, the anterior reinforcing bridge may alternatively be referred to as an anterior stiffener, an anterior stabilizer, an anterior beam or an anterior bar.

The anterior arch support of the insole may comprise or be constituted by a shock absorbing material or damping material (e.g. PORON®). The damping material may be locally provided to the anterior arch support. Alternatively, the insole may comprise a damping layer. This damping layer may have a substantially uniform thickness but once laid upon the anterior reinforcing bridge it may define the anterior arch support of the insole.

The anterior arch support may have a generally circular or droplet shaped appearance. If a droplet shape is employed, the droplet may point backwards in a longitudinal direction of the insole, i.e. towards a heel region of the insole. The anterior arch support may be successively vertically raised with respect to the adjacent surface of the insole.

The anterior arch support may have a maximum length in the longitudinal direction of the insole that is 10% to 30%, such as 15% to 25%, such as 18% to 22%, such as 20%, of the length of the insole in the longitudinal direction. Moreover, the anterior arch support may have a maximum length in the lateral direction (width direction) of the insole that is 40% to 60%, such as 45% to 55%, such as 48% to 52%, such as 50%, of the local width of the insole in the lateral direction where the anterior arch support is provided.

The anterior arch support may be positioned (e.g. with its geometrical center point) at a distance from a front tip of the insole that is 35% to 45%, such as 38% to 42%, such as 40%, of the longitudinal length of the insole. The anterior arch support may be substantially centered in the lateral direction of the insole.

The anterior reinforcing bridge may extend substantially in a lateral direction of the insole. Thus, the anterior reinforcing bridge may have an elongated appearance. As seen from above, the anterior reinforcing bridge may be substantially straight.

The anterior reinforcing bridge may be positioned (e.g. with its geometrical center point) at a distance from a front tip of the insole that is 30% to 50%, such as 35% to 45%, such as 37% to 41%, such as 39%, of the longitudinal length of the insole.

The anterior reinforcing bridge may have a width in the longitudinal direction of the insole that is 2% to 6%, such as 4%, of the longitudinal length of the insole. Alternatively, the anterior reinforcing bridge may have a width in the longitudinal direction of the insole of 5 to 15 mm, such as 8 to 12 mm, such as 9 to 11 mm, such as 10 mm. In other words, the length of the anterior reinforcing bridge may be independent of the size of the footwear.

The raised section of the anterior reinforcing bridge may span over substantially the entire width of the insole. In other words, the anterior reinforcing bridge may have a generally arc shaped appearance. Alternatively, the raised section of the anterior reinforcing bridge may only span over a partial distance (e.g. a central section) of the width of the insole. For example, the raised section may be an intermediate raised section of the anterior reinforcing bridge arranged between two further sections (e.g. two substantially flat sections). In these alternative variants, the intermediate raised section may have a length in the lateral direction that is 30% to 70%, such as 40 to 60%, such as 50%, of the local lateral width of the insole where the anterior reinforcing bridge is provided.

As used herein, a substantially perpendicular/parallel relationship includes a perfectly perpendicular/parallel relationship as well as deviations from a perfectly perpendicular/parallel relationship with up to 10%, such as up to 5%, such as up to 2%. Similarly, a substantially corresponding distance as used herein includes a perfectly corresponding distance as well as deviations from a perfectly corresponding distance with up to 10%, such as up to 5%, such as up to 2%.

The anterior reinforcing bridge may be convex as seen in an anterior direction of the insole. The anterior reinforcing bridge may thus have a substantially downwardly directed cavity and/or a substantially upwardly directed bulge. An anterior direction of the insole and a forward longitudinal direction of the insole as used herein are intended to be the same direction. These directions are directions along the anterior axis or the longitudinal axis of the insole.

The insole may further comprise a medial arch support; a lateral arch support; and at least one transverse reinforcing bridge having two raised sections for providing resistance against compression of the medial arch support and the lateral arch support, respectively. Each of the medial arch support and the lateral arch support may have a generally arch shaped appearance as seen from above. The arc may point inwards substantially in the lateral direction of the insole. The medial arch support and the lateral arch support may be successively vertically raised with respect to the adjacent surface of the insole.

The at least one transverse reinforcing bridge thus adds rigidity to the medial arch support and the lateral arch support and contributes to maintaining the original shape of the medial arch support and the lateral arch support over time. Moreover, the at least one transverse reinforcing bridge prevents the insole from bending about a central longitudinal axis. Throughout the present disclosure, the transverse reinforcing bridge may alternatively be referred to as a transverse stiffener, a transverse stabilizer, a transverse beam or a transverse bar.

The medial arch support may have a length in the longitudinal direction of the insole that is 35% to 60%, such as 40% to 55%, such as 45% to 50%, such as 48%, of the length of the insole in the longitudinal direction. The lateral arch support may have a length in the longitudinal direction of the insole that is 40% to 65%, such as 45% to 60%, such as 50% to 55%, such as 53%, of the length of the insole in the longitudinal direction.

The medial arch support may be positioned (e.g. with its geometrical center point) at a distance from a front tip of the insole that is 55% to 70%, such as 60% to 65%, such as 63%, of the longitudinal length of the insole. Also the lateral arch support may be positioned (e.g. with its geometrical center point) at a distance from a front tip of the insole that is 55% to 70%, such as 60% to 65%, such as 63%, of the longitudinal length of the insole.

The medial arch support and the lateral arch support of the insole may comprise or be constituted by a shock absorbing material or a damping material (e.g. PORON®). The damping material may be locally provided to the medial arch support and the lateral arch support, respectively. Alternatively, the insole may comprise a damping layer. This damping layer may have a substantially uniform thickness but once laid upon the one or more transverse reinforcing bridges, it may define the medial arch support and the lateral arch support of the insole.

One or each of the transverse reinforcing bridges may extend substantially in a lateral direction of the insole. Thus, each transverse reinforcing bridge may have an elongated appearance.

The at least one transverse reinforcing bridge may extend substantially in a lateral direction of the insole. The insole may comprise two substantially parallel transverse reinforcing bridges.

In case the insole comprises two transverse reinforcing bridges, a first anterior transverse reinforcing bridge may be positioned (e.g. with its geometrical center point) at a distance from a front tip of the insole that is 50% to 65%, such as 55% to 60%, such as 57%, of the longitudinal length of the insole. A second posterior transverse reinforcing bridge may be positioned (e.g. with its geometrical center point) at a distance from a front tip of the insole that is 65% to 75%, such as 68% to 72%, such as 70%, of the longitudinal length of the insole.

Each of these two transverse reinforcing bridges may have a width in the longitudinal direction of the insole that is 2% to 6%, such as 4%, of the longitudinal length of the insole. Alternatively, the transverse reinforcing bridge may have a width in the longitudinal direction of the insole of 5 to 15 mm, such as 8 to 12 mm, such as 9 to 11 mm, such as 10 mm. In other words, the width of the transverse reinforcing bridge may be independent of the size of the footwear.

As a further example, the insole may comprise only one single transverse reinforcing bridge. This single transverse reinforcing bridge may be constituted by one of the two transverse reinforcing bridges as described above and positioned at one of the described positions. However, as one example, such single transverse reinforcing bridge may be positioned (e.g. with its geometrical center point) at a distance from a front tip of the insole that is 55% to 75%, such as 60% to 70%, such as 62% to 66%, such as 64%, of the longitudinal length of the insole.

Alternatively, the insole may comprise only one relatively wider single transverse reinforcing bridge. This single transverse reinforcing bridge may be positioned (e.g. with its geometrical center point) at a distance from a front tip of the insole that is 55% to 75%, such as 60% to 70%, such as 62% to 66%, such as 64%, of the longitudinal length of the insole. However, the width of such relatively wider single transverse reinforcing bridge in the longitudinal direction of the insole may be 10% to 30%, such as 15% to 25%, such as 17% to 21%, such as 19% of the longitudinal length of the insole. Alternatively, the single wider transverse reinforcing bridge may have a width in the longitudinal direction of the insole of 30 to 60 mm, such as 40 to 50 mm, such as 45 mm. In other words, the length of the transverse reinforcing bridge may be independent of the size of the footwear.

The at least one transverse reinforcing bridge may be concave as seen in an anterior direction of the insole. The at least one transverse reinforcing bridge may thus have a substantially upwardly directed cavity and/or a substantially downwardly directed bulge.

The at least one transverse reinforcing bridge may have a continuous concave arc shape. In this case, the two ends of the arc shape may constitute the respective raised sections of the transverse reinforcing bridge.

Alternatively, the at least one transverse reinforcing bridge may comprise a substantially straight intermediate section between two outer curved sections constituting the respective raised section of the transverse reinforcing bridge. In other words, the at least one transverse reinforcing bridge may have a general shape of a widened "U". In this case, the length of the intermediate section of the transverse reinforcing bridge may be 40% to 55%, such as 45% to 50%, such as 48%, of the local lateral width of the insole where the transverse reinforcing bridge is provided. Such intermediate section of the transverse reinforcing bridge may span between the lateral arch support and the medial arch support.

The insole may further comprise at least one oblique reinforcing bridge inclined with respect to an anterior direction of the insole.

Each of the oblique reinforcing bridges may extend at an angle with respect to the anterior direction or the longitudinal direction of the insole from a posterior, medial point to an anterior lateral point of the insole. A mirrored configuration of the at least one oblique reinforcing bridge is also possible. Furthermore, each oblique reinforcing bridge may extend at an angle with respect to the longitudinal direction of the insole that is 30° to 45°, such as 35° to 40°, such as 37°.

The at least one oblique reinforcing bridge thus adds rigidity to the medial arch support and the lateral arch support and contributes to maintaining the original shape of the medial arch support and the lateral arch support over time. Moreover, the at least one oblique reinforcing bridge prevents the insole from twisting about its longitudinal axis. Throughout the present disclosure, the oblique reinforcing bridge may alternatively be referred to as an oblique stiffener, an oblique stabilizer, an oblique beam or an oblique bar.

As one example, the insole may comprise two oblique reinforcing bridges. A first oblique reinforcing bridge may extend from a posterior point of the medial arch support to an anterior point of the lateral arch support. A second oblique reinforcing bridge may be arranged posterior of the first oblique reinforcing bridge and may also extend from a posterior point of the medial arch support to an anterior point of the lateral arch support. The first and second oblique reinforcing bridges may be substantially parallel.

Each oblique reinforcing bridge may have an elongated appearance. As seen from above, each oblique reinforcing bridge may be substantially straight. Moreover, each oblique reinforcing bridge may have a width in a direction substantially perpendicular to its general extension direction of 5 to 15 mm, such as 8 to 12 mm, such as 9 to 11 mm, such as 10 mm.

As a further example, the insole may comprise only one single oblique reinforcing bridge. This single oblique reinforcing bridge may be constituted by one of the two oblique reinforcing bridge as described above. However, such single oblique reinforcing bridge may optionally be widened. For example, such widened oblique reinforcing bridge may have a width in a direction substantially perpendicular to its general extension direction of 30 to 50 mm, such as 35 to 45 mm, such as 40 mm.

The at least one oblique reinforcing bridge may comprise one or two raised sections for providing resistance against compression of one or both of the medial arch support and/or the lateral arch support.

The at least one oblique reinforcing bridge may have a continuous concave arc shape. In this case, the two ends of the arc shape may constitute the respective raised sections of the oblique reinforcing bridge.

Alternatively, the at least one oblique reinforcing bridge may comprise a substantially straight intermediate section between two outer curved sections constituting the respective raised section of the oblique reinforcing bridge. In other words, the at least one oblique reinforcing bridge may have a general shape of a widened "U". the intermediate section of the transverse reinforcing bridge may span between the lateral arch support and the medial arch support.

As a further alternative, a first anterior oblique reinforcing bridge may comprise only one raised section connected to a substantially straight section. The single raised section of the first anterior oblique reinforcing bridge may be arranged to support the medial arch support. A second posterior oblique reinforcing bridge may comprise a substantially straight intermediate section between two outer curved sections constituting the raised sections to support both the medial arch support and the lateral arch support. Alternatively, the second posterior oblique reinforcing bridge may comprise only one raised section connected to a substantially straight section. In this case, the single raised section of the second posterior oblique reinforcing bridge may be arranged to support the lateral arch support.

Each reinforcing bridge as referred to herein may be a sheet of metal or hard plastics.

The insole may further comprise a top layer, a bottom layer and a bridge layer wherein the bridge layer comprises the one or more reinforcing bridges. The bridge layer may be an intermediate layer, i.e. provided between the top layer and the bottom layer.

The insole may further comprise a damping layer. The damping layer may be an intermediate layer, i.e. provided between the top layer and the bottom layer. The insole may comprise, in order from the top of the insole: the top layer, the damping layer, the bridge layer and the bottom layer. Additional layers may or may not be provided.

The bridge layer may only comprise the one or more reinforcing bridges. Thus, the one or more reinforcing bridges may be the only constituent(s) of the bridge layer. In this manner, the flexibility of the insole can be improved while stile providing an anatomical support. Moreover, the use of excess material can be avoided and the weight of the insole can be reduced.

According to a further aspect, there is provided a footwear comprising an insole according to the present disclosure. The footwear may for example be shoes, boots, sandals or slippers.

The insole may be a partial insole. Such partial insole may be constituted by an insert. In case the insole is constituted by a partial insole, the examples of positions, dimensions and orientations as given above apply with respect to a length and width of the inside of the footwear in which the insole is provided or is to be provided. The insole may be integrally formed with the footwear.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1:
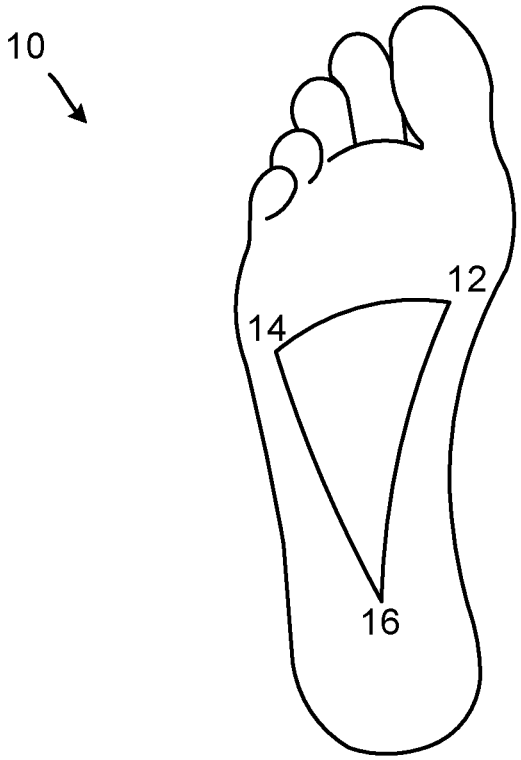
FIG. 1: schematically represents a bottom view of a foot.

In the following, an insole comprising at least one reinforcing bridge and a footwear comprising the insole will be described. The same reference numerals will be used to denote the same or similar structural features.

FIG. 1 schematically represents a bottom view of a foot 10. A typical foot 10 (here a right foot) comprises an anterior transverse arch or anterior arch illustrated by the lines 12, 14, a lateral longitudinal arch or a lateral arch illustrated by the lines 14, 16, and a medial longitudinal arch or medial arch illustrated by the lines 12, 16.

Figure 2:
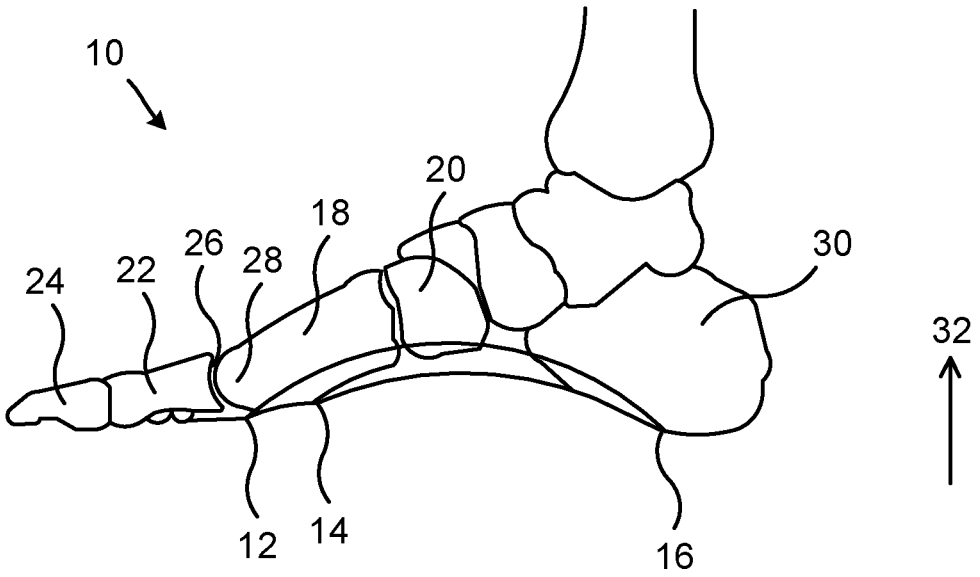
FIG. 2: schematically represents a lateral side view of bones in the foot.

FIG. 2 schematically represents a lateral side view of bones in the foot 10. The foot 10 comprises five metatarsals or metatarsal bones 18 located between the tarsal bones 20 and the phalanges. The phalanges are the bones in the toes and each toe except the large toe comprises a proximal phalange 22, an intermediate phalange and a distal phalange 24. The large toe only has two phalanges 22, 24. A metatarsal phalangeal joint 26 joins each metatarsal 18 to a respective proximal phalange 22. The metatarsal heads 28 are the ends of the metatarsals 18 closest to the proximal phalanges 22.

As can be seen in FIG. 2, the anterior arch 12, 14 is located below the metatarsal heads 28. The medial arch 12, 16 spans from below the first metatarsal head 28 to below the calcaneus 30. The lateral arch spans from below the fifth metatarsal head 28 to below the calcaneus 30. FIG. 2 further illustrates a vertical direction 32 with respect to the foot 10.

Figure 3:
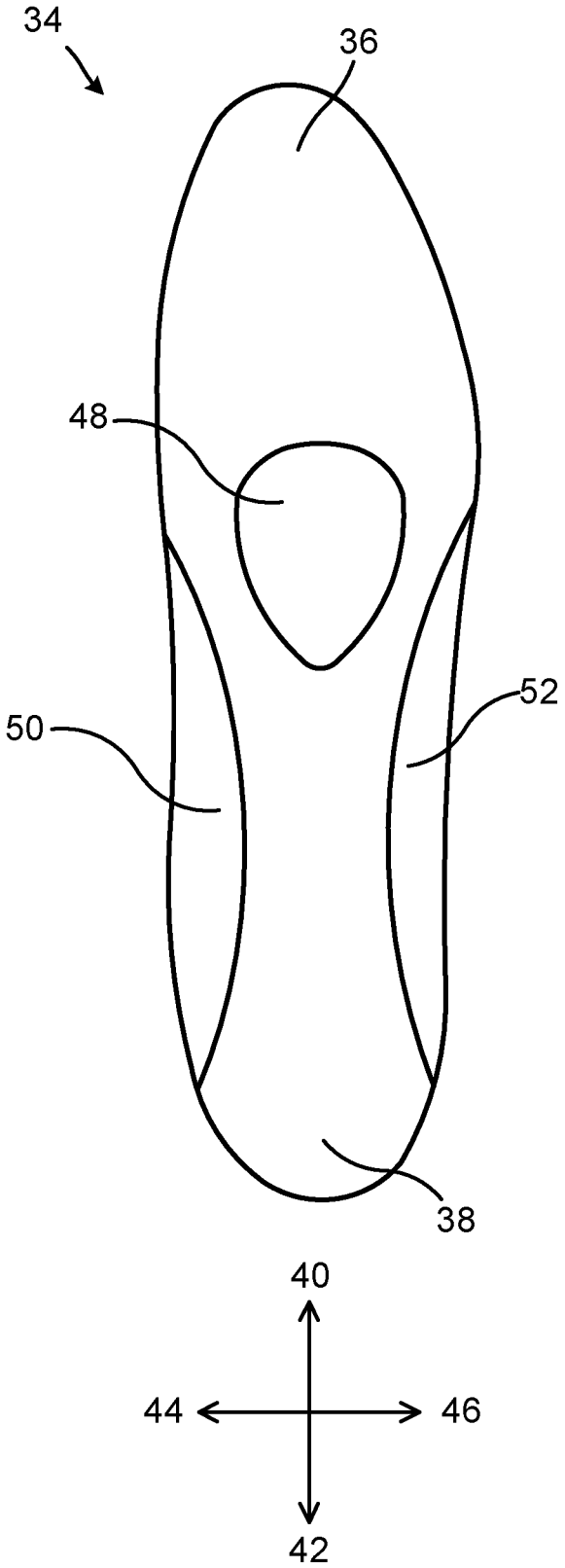
FIG. 3: schematically represents a top view of an insole.

FIG. 3 schematically represents a top view of an insole 34. The insole 34 comprises a toe region 36 and a heel region 38. The insole 34 may be inserted in various types of footwear.

Also illustrated in FIG. 3 is a coordinate system showing an anterior direction 40, a posterior direction 42, a medial direction 44 and a lateral direction 46. The anterior direction 40 may alternatively be referred to as a forward longitudinal direction and the posterior direction 42 may alternatively be referred to as a rearward longitudinal direction. Moreover, since the insole 34 in FIG. 3 is for a right foot 10, the lateral direction 46 may alternatively be referred to as a lateral right direction and the medial direction 44 may alternatively be referred to as a lateral left direction.

The insole 34 comprises an anterior arch support 48, a medial arch support 50 and a lateral arch support 52. Each of the anterior arch support 48, the medial arch support 50 and the lateral arch support 52 is raised vertically with respect to the respective adjacent surfaces of the insole 34.

In this example, the anterior arch support 48 has a general droplet shape where the tip of the droplet points in the posterior direction 42. The anterior arch support 48 is substantially centered in the lateral direction 46 of the insole 34.

The anterior arch support 48 has a maximum length in the longitudinal direction of the insole 34 that is approximately 20% of the length of the insole 34 in the longitudinal direction 40. Moreover, the anterior arch support 48 has a maximum length in the width direction (i.e. in the lateral direction 46) of the insole 34 that is approximately 50%, of the local width of the insole 34 in the lateral direction 46 where the anterior arch support 48 is provided. Moreover, the anterior arch support 48 is positioned with its geometrical center point at a distance from a front tip of the insole 34 that is approximately 40% of the longitudinal length of the insole 34.

As can be seen in FIG. 3, each of the medial arch support 50 and the lateral arch support 52 has a generally arch shaped appearance with an inwardly pointing arc. Each of the anterior arch support 48, the medial arch support 50 and the lateral arch support 52 is successively vertically raised with respect to the respective adjacent surface of the insole 34.

The medial arch support 50 has a length in the longitudinal direction 40 of the insole 34 that is approximately 48% of the length of the insole 34 in the longitudinal direction 40. The lateral arch support 52 has a length in the longitudinal direction 40 of the insole 34 that is approximately 53% of the length of the insole 34 in the longitudinal direction 40.

Each of the medial arch support 50 and the lateral arch support 52 is positioned with its geometrical center point at a distance from a front tip of the insole 34 that is approximately 63% of the longitudinal length of the insole 34. The anterior arch support 48, the medial arch support 50 and the lateral arch support 52 of this implementation comprises a shock absorbing material.

Figure 4:
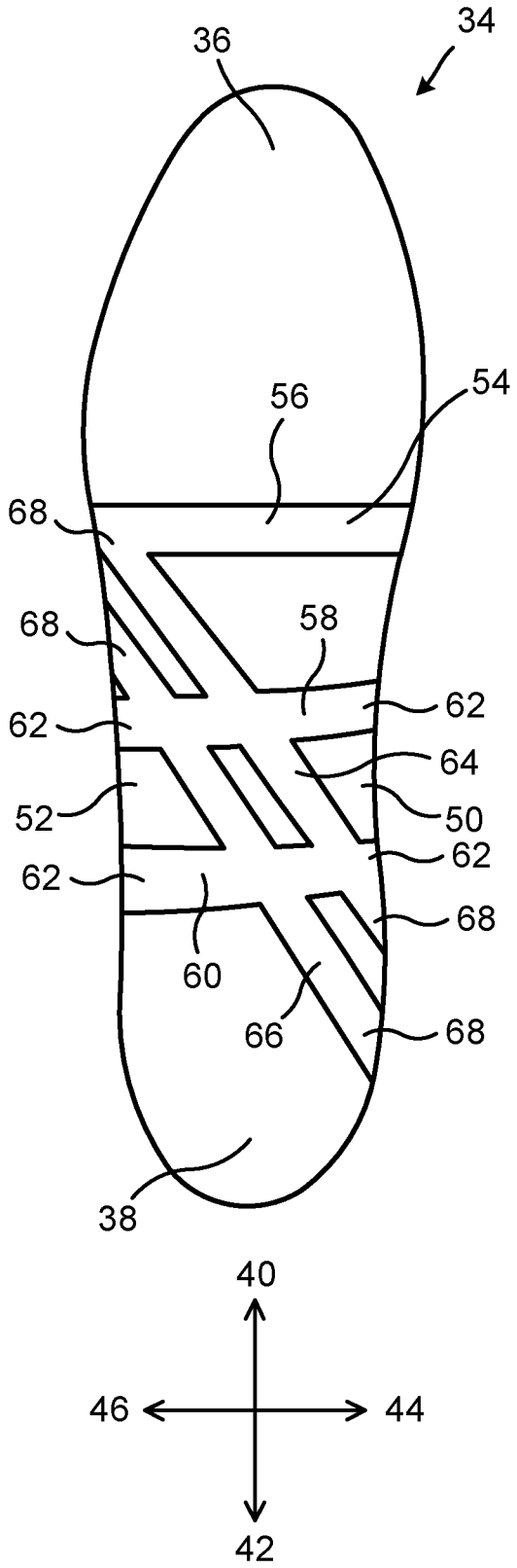
FIG. 4: schematically represents a bottom view of the insole.
Figure 5:
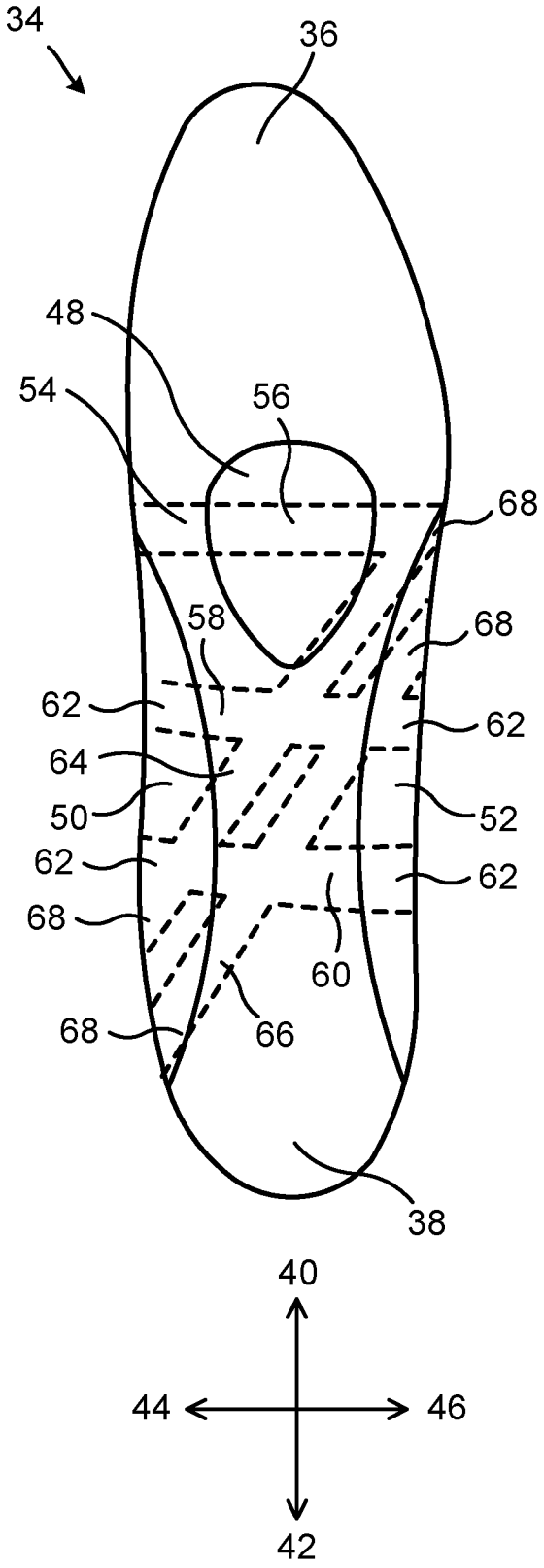
FIG. 5: schematically represents a top view of the insole and reinforcing bridges.

FIG. 4 schematically represents a bottom view of the insole 34 and FIG. 5 schematically represents a top view of the insole 34 and where hidden reinforcing bridges are illustrated with dashed lines. With collective reference to FIGS. 4 and 5, the insole 34 comprises an anterior reinforcing bridge 54. The anterior reinforcing bridge 54 comprises a raised section 56 for providing rigidity, strength and compression resistance to the anterior arch support 48 over time.

In this implementation, the anterior reinforcing bridge 54 has an elongated appearance and extends substantially in the lateral direction 46 of the insole 34. The anterior reinforcing bridge 54 is positioned with its geometrical center point at a distance from a front tip of the insole 34 that is approximately 39% of the longitudinal length of the insole 34. Furthermore, the anterior reinforcing bridge 54 has a width in the longitudinal direction 40 of the insole 34 that is approximately 4% of the longitudinal length of the insole 34 and/or approximately 10 mm.

The insole 34 further comprises two transverse reinforcing bridges 58, 60. Each transverse reinforcing bridge 58, 60 has two raised sections 62 for providing resistance against compression of the medial arch support 50 and the lateral arch support 52, respectively. The transverse reinforcing bridges 58, 60 thus adds rigidity to the medial arch support 50 and the lateral arch support 52 and contributes to maintaining the original shape of the medial arch support 50 and the lateral arch support 52 over time. Moreover, the two transverse reinforcing bridges 58, 60 prevent the insole 34 from bending about a central longitudinal axis.

Each of the two transverse reinforcing bridges 58, 60 has an elongated appearance and extends substantially in the lateral direction 46 of the insole 34. The first anterior transverse reinforcing bridge 58 is positioned with its geometrical center point at a distance from the front tip of the insole 34 that is approximately 57% of the longitudinal length of the insole 34. The second posterior transverse reinforcing bridge 60 is positioned with its geometrical center point at a distance from a front tip of the insole 34 that is approximately 70% of the longitudinal length of the insole 34. Each of the two transverse reinforcing bridges 58, 60 has a width in the longitudinal direction 40 of the insole 34 that is approximately 4% of the longitudinal length of the insole 34 and/or approximately 10 mm.

The insole 34 further comprises two substantially parallel oblique reinforcing bridges 64, 66 inclined with respect to the longitudinal axis 40 of the insole 34. Each of the oblique reinforcing bridges 64, 66 has an elongated appearance and extends at an angle with respect to the longitudinal axis 40 of the insole 34 from a posterior, medial point to an anterior lateral point of the insole 34 at an angle with respect to the longitudinal direction 40 of the insole 34 that is approximately 37°.

The anterior oblique reinforcing bridge 64 extends from a posterior point of the medial arch support 50 to an anterior point of the lateral arch support 52. The posterior oblique reinforcing bridge 66 also extends from a posterior point of the medial arch support 50 to an anterior point of the lateral arch support 52. Each oblique reinforcing bridge 64, 66 has a width of approximately 10 mm.

Each oblique reinforcing bridge 64, 66 comprises two raised sections 68 for providing resistance against compression of the medial arch support 50 and/or the lateral arch support 52. However, one or both of the oblique reinforcing bridge 64, 66 may only comprise one raised section 68 or no raised section 68.

The two oblique reinforcing bridges 64, 66 add rigidity to the medial arch support 50 and the lateral arch support 52 and contribute to maintaining the original shape of the medial arch support 50 and the lateral arch support 52 over time. Moreover, the two oblique reinforcing bridges 64, 66 prevent the insole 34 from twisting about the longitudinal axis 40.

The oblique reinforcing bridges 64, 66 are connected to the transverse reinforcing bridges 58, 60 at their crossing areas. The anterior oblique reinforcing bridge 64 is connected to the anterior reinforcing bridge 54 at their crossing area. As an alternative to connecting the reinforcing bridges 54, 58, 60, 64, 66, all or some of the reinforcing bridges 54, 58, 60 64, 66, may be integrally formed. The reinforcing bridges 54, 58, 60 64, 66, may constitute a bridge layer. A bottom layer may cover the reinforcing bridges 54, 58, 60, 64, 66. A damping layer may further be provided between a top layer and the bridge layer.

Figure 6A:
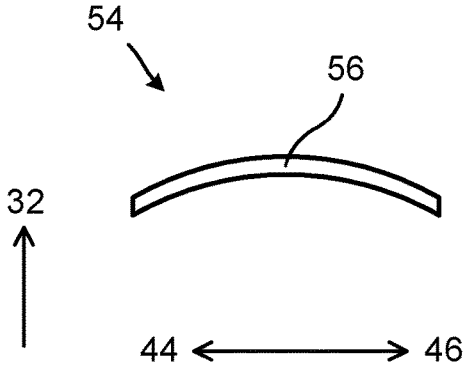
FIG. 6*a*: schematically represents an anterior view of an anterior reinforcing bridge.

FIG. 6*a* schematically represents an anterior view of an anterior reinforcing bridge 54. As can be seen, the raised section 56 of the anterior reinforcing bridge 54 is raised in the vertical direction 32. The raised section 56 of this anterior reinforcing bridge 54 has a generally arc shaped appearance and spans over substantially the entire width of the insole 34.

Figure 6B:
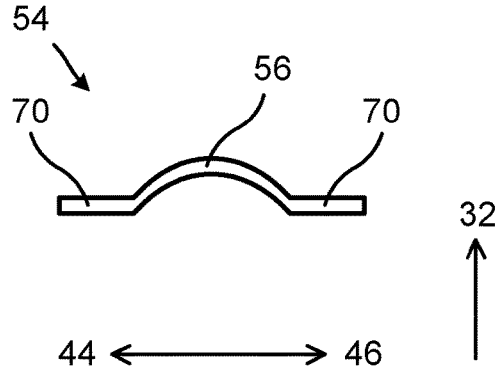
FIG. 6*b*: schematically represents an anterior view of an alternative anterior reinforcing bridge.

FIG. 6*b* schematically represents an anterior view of an alternative anterior reinforcing bridge 54. The raised section 56 of this anterior reinforcing bridge 54 only spans over a partial distance (e.g. a central section) of the width of the insole 34. Here, the raised section 56 is an intermediate raised section 56 of the anterior reinforcing bridge 54 arranged between two further substantially straight sections 70 of the anterior reinforcing bridge 54. In this implementation, the intermediate raised section 56 has a length in the lateral direction 46 that is approximately 50% of the local lateral width of the insole 34 where the anterior reinforcing bridge 54 is provided.

Each of the anterior reinforcing bridges 54 in FIGS. 6*a* and 6*b* is convex as seen in the anterior direction 40 of the insole 34. In these implementations, the anterior reinforcing bridge 54 has a substantially downwardly directed cavity and a substantially upwardly directed bulge.

Figure 7A:
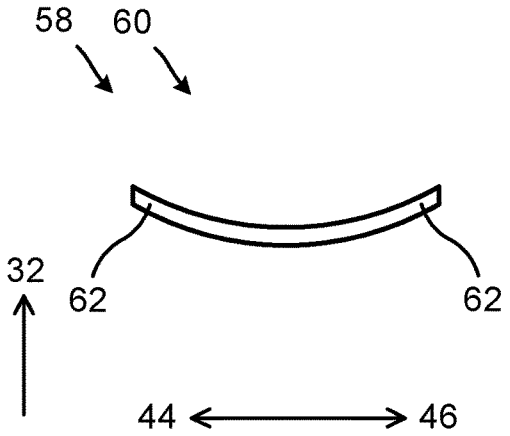
FIG. 7*a*: schematically represents an anterior view of a transverse reinforcing bridge.

FIG. 7*a* schematically represents an anterior view of an anterior transverse reinforcing bridge 58 and/or a posterior transverse reinforcing bridge 60. The transverse reinforcing bridge 58, 60 is concave as seen in the anterior direction 40 of the insole 34 and has a substantially upwardly directed cavity and a substantially downwardly directed bulge. The transverse reinforcing bridge 58, 60 thus has a continuous concave arc shape. In this case, the two ends of the arc shape constitutes the respective raised sections 62 of the transverse reinforcing bridges 58, 60.

Figure 7B:
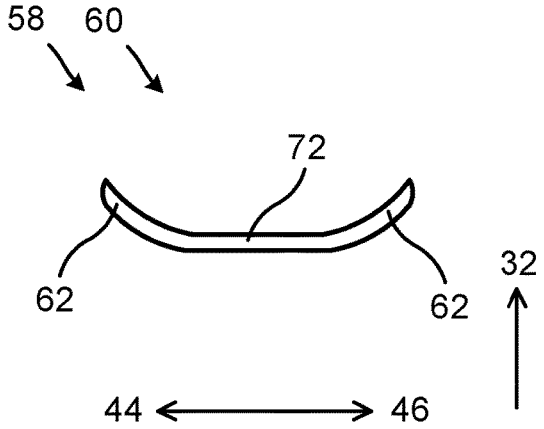
FIG. 7*b*: schematically represents an anterior view of an alternative transverse reinforcing bridge.

FIG. 7*b* schematically represents an anterior view of an alternative transverse reinforcing bridge 58, 60. Also this design may be used for an anterior transverse reinforcing bridge 58 and/or a posterior transverse reinforcing bridge 60. The transverse reinforcing bridge 58, 60 comprises a substantially straight intermediate section 72 between two outer curved sections constituting the respective raised section 62 of the transverse reinforcing bridge 58, 60. The transverse reinforcing bridge 58, 60 thereby has a general shape of a widened "U". In this case, the length of the intermediate section of the transverse reinforcing bridge 58, 60 is approximately 48%, of the local lateral width of the insole 34 where the transverse reinforcing bridge 58, 60 is provided. In other words, the intermediate section 72 of the transverse reinforcing bridge 58, 60 spans between the lateral arch support 52 and the medial arch support 50.

Figure 8A:
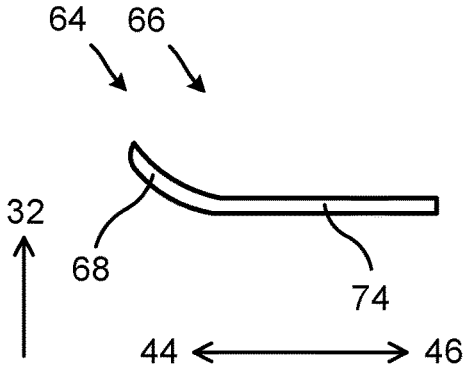
FIG. 8*a*: schematically represents an anterior view of an oblique reinforcing bridge.

FIG. 8*a* schematically represents an anterior view of an anterior oblique reinforcing bridge 64 and/or a posterior oblique reinforcing bridge 66. The oblique reinforcing bridge 64, 66 may comprise only one raised section 68 connected to a substantially straight section 74. The single raised section 68 of a first anterior oblique reinforcing bridge 64 may for example be arranged to support the medial arch support 50. Alternatively, or in addition, the single raised section 68 of a second posterior oblique reinforcing bridge 66 may for example be arranged to support the lateral arch support 52. The substantially straight section 74 of the oblique reinforcing bridge 64, 66 may span between one or both of the lateral arch support 52 and the medial arch support 50 and one or both of an outer lateral edge of the insole 34.

Figure 8B:
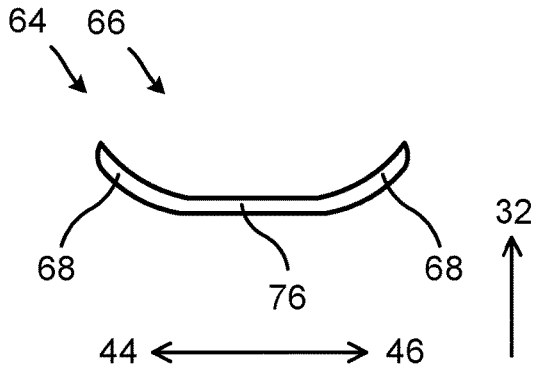
FIG. 8*b*: schematically represents an anterior view of an alternative oblique reinforcing bridge.

FIG. 8*b* schematically represents an anterior view of an alternative design for an anterior oblique reinforcing bridge 64 and/or a posterior oblique reinforcing bridge 66. The oblique reinforcing bridge 64, 66 of this example comprises a substantially straight intermediate section 76 between two outer curved sections constituting the raised sections 68 to support both the medial arch support 50 and the lateral arch support 52.

The oblique reinforcing bridge 64, 66 thereby has a general shape of a widened "U".

One or each of the oblique reinforcing bridges 64, 66 may however have a continuous concave arc shape as seen in the anterior direction 40 of the insole 34 and have a substantially upwardly directed cavity and a substantially downwardly directed bulge. In this case, the two ends of the arc shape may constitute the respective raised sections 68 of the oblique reinforcing bridge 64, 66.

While the present disclosure has been described with reference to exemplary embodiments, it will be appreciated that the present invention is not limited to what has been described above. For example, it will be appreciated that the dimensions of the parts may be varied as needed. Accordingly, it is intended that the present invention may be limited only by the scope of the claims appended hereto.

The invention claimed is:

1. An insole for footwear, the insole comprising:

an anterior arch support comprising a shock absorbing material or a damping material;

an anterior reinforcing bridge having a raised section for providing resistance against compression of the anterior arch support, wherein the raised section is raised vertically upwardly with respect to a general horizontal plane of the insole toward the anterior arch support and comprises a concave surface as seen in an anterior direction of the insole, the concave surface facing away from the anterior arch support, wherein:

the raised section as viewed in a vertical direction normal to the general horizontal plane is shaped as an elongated beam in a lateral direction of the insole; and the anterior reinforcing bridge is positioned at a distance from a front tip of the insole that is 30% to 50% of a longitudinal length of the insole;

a medial arch support;

a lateral arch support;

two transverse reinforcing bridges, each having two raised sections for providing resistance against compression of the medial arch support and the lateral arch support, respectively, and each transverse reinforcing bridge shaped as an elongated beam in a lateral direction of the insole as viewed in a vertical direction normal to the general horizontal plane; and two oblique reinforcing bridges inclined with respect to an anterior direction of the insole, each oblique reinforcing bridge comprising one or two raised sections for providing resistance against compression of one or both of the medial arch support and/or the lateral arch support, and each oblique reinforcing bridge shaped as an elongated beam as viewed in a vertical direction normal to the general horizontal plane.

2. The insole according to claim 1, wherein the anterior arch support has a maximum length in a longitudinal direction of the insole that is 10% to 30% of a length of the insole in the longitudinal direction.

3. The insole according to claim 1, wherein the anterior arch support has a maximum length in a lateral direction of the insole that is 40% to 60% of a local width of the insole in the lateral direction where the anterior arch support is provided.

4. The insole according to claim 1, wherein the anterior arch support is positioned with its geometrical center point at a distance from a front tip of the insole that is 35% to 45% of the longitudinal length of the insole.

5. The insole according to claim 1, wherein the raised section of the anterior reinforcing bridge only spans over a partial distance of a width of the insole where the anterior reinforcing bridge is provided.

6. The insole according to claim 1, wherein each of the transverse reinforcing bridges is concave as seen in an anterior direction of the insole.

7. The insole according to claim 1, further comprising:

a top layer;

a bottom layer; and a bridge layer;

wherein the bridge layer comprises the anterior reinforcing bridge.

8. The insole according to claim 7, wherein the bridge layer only comprises the anterior reinforcing bridge.

9. Footwear comprising the insole according to claim 1.

10. The insole according to claim 5, wherein the partial distance is 30% to 70% of a local width of the insole where the anterior reinforcing bridge is provided.

11. An insole for footwear, the insole comprising:

an anterior arch support comprising a shock absorbing material or a damping material;

a bridge layer comprising an anterior reinforcing bridge having a raised section raised toward the anterior arch support for providing resistance against compression of the anterior arch support, the raised section having a concave surface facing away from the anterior arch support as viewed in an anterior direction of the insole and a convex surface opposed the concave surface and facing the anterior arch support as viewed in the anterior direction of the insole, wherein:

the raised section as viewed in a vertical direction normal to the general horizontal plane is shaped as an elongated beam in a lateral direction of the insole; and the anterior reinforcing bridge is positioned at a distance from a front tip of the insole that is 30% to 50% of a longitudinal length of the insole, a medial arch support;

a lateral arch support;

two transverse reinforcing bridges, each having two raised sections for providing resistance against compression of the medial arch support and the lateral arch support, respectively, and each transverse reinforcing bridge shaped as an elongated beam in a lateral direction of the insole as viewed in a vertical direction normal to the general horizontal plane; and two oblique reinforcing bridges inclined with respect to an anterior direction of the insole, each oblique reinforcing bridge comprising one or two raised sections for providing resistance against compression of one or both of the medial arch support and/or the lateral arch support, and each oblique reinforcing bridge shaped as an elongated beam as viewed in a vertical direction normal to the general horizontal plane.

12. The insole according to claim 1, wherein the anterior reinforcing bridge spans over an entire distance of a width of the insole where the anterior reinforcing bridge is provided.

13. The insole according to claim 1, wherein the anterior reinforcing bridge has a width that is 2% to 6% of the longitudinal length of the insole.

14. The insole according to claim 1, wherein the anterior reinforcing bridge has a width of 5 mm to 15 mm as measured in a longitudinal direction of the insole.

15. The insole according to claim 1, wherein the raised section has a length in the lateral direction that is at least 30% of the local lateral width of the insole where the anterior reinforcing bridge is provided.

16. The insole according to claim 1, wherein the shock absorbing material or damping material is locally provided at a portion of the insole constituting the anterior arch support.

* * * * *